United States Patent [19]

Cheng

[11] Patent Number: 4,662,474

[45] Date of Patent: May 5, 1987

[54] NOISE SUPPRESSOR FOR PNEUMATIC TOOL

[76] Inventor: Ming-Shin Cheng, No. 891-26, Chung Cheng Road, Hsin Chuang City, Taipei Hsien, Taiwan

[21] Appl. No.: 840,690

[22] Filed: Mar. 18, 1986

[51] Int. Cl.[4] ..... F01N 1/08

[52] U.S. Cl. ..... 181/230; 181/239; 181/279

[58] Field of Search ..... 181/230, 279, 280, 248, 181/239

[56] References Cited

U.S. PATENT DOCUMENTS 3,144,913 8/1964 Bailey ..... 181/248

4,367,807 1/1983 Fink et al. ..... 181/230

4,474,260 10/1984 Valentine ..... 181/230

*Primary Examiner*—Benjamin R. Fuller

*Attorney, Agent, or Firm*—Lane & Aitken

[57] ABSTRACT

A noise suppressor for a pneumatic tool characterized by a plurality of annular or spiral suppression grooves on the inner wall of the body of pneumatic tool and a plurality of air being holes at the bottom of the suppression grooves on a side wall so that compressed air discharged can have its flow disturbed by impingement upon the suppression grooves and side wall and thus the time of discharge is prolonged and the noise from discharge of the compressed air is suppressed.

1 Claim, 2 Drawing Figures

NOISE SUPPRESSOR FOR PNEUMATIC TOOL

BACKGROUND OF THE INVENTION

Generally, a pneumatic tool applies compressed air to drive a built-in air motor and consequentially a tool. Discharge of compressed air from a pneumatic tool always results in a loud and uncomfortable noise because of the strong force of the air flow. In view of this problem, the inventor created a noise suppressor of new structure for a pneumatic tool. It includes some suppression grooves on an inner wall of the the body of pneumatic tool to disturb compressed air flow and to cause a collision of compressed air with the groove so that noise caused by the air flow is greatly reduced. Its structure is simple and practical.

SUMMARY OF THE INVENTION

The present invention provides a structure for noise suppression in a pneumatic tool, particularly for suppression of the noise of compressed air from the air motor of the pneumatic tool, which provides a plurality of annular or spiral suppression grooves on the inner wall of its body and a plurality of air holes at the bottom of the grooves in order to disturb air flow from the air motor prior to discharge through the air hole for noise suppression.

DESCRIPTION OF PREFERRED EMBODIMENT

Figure 1:
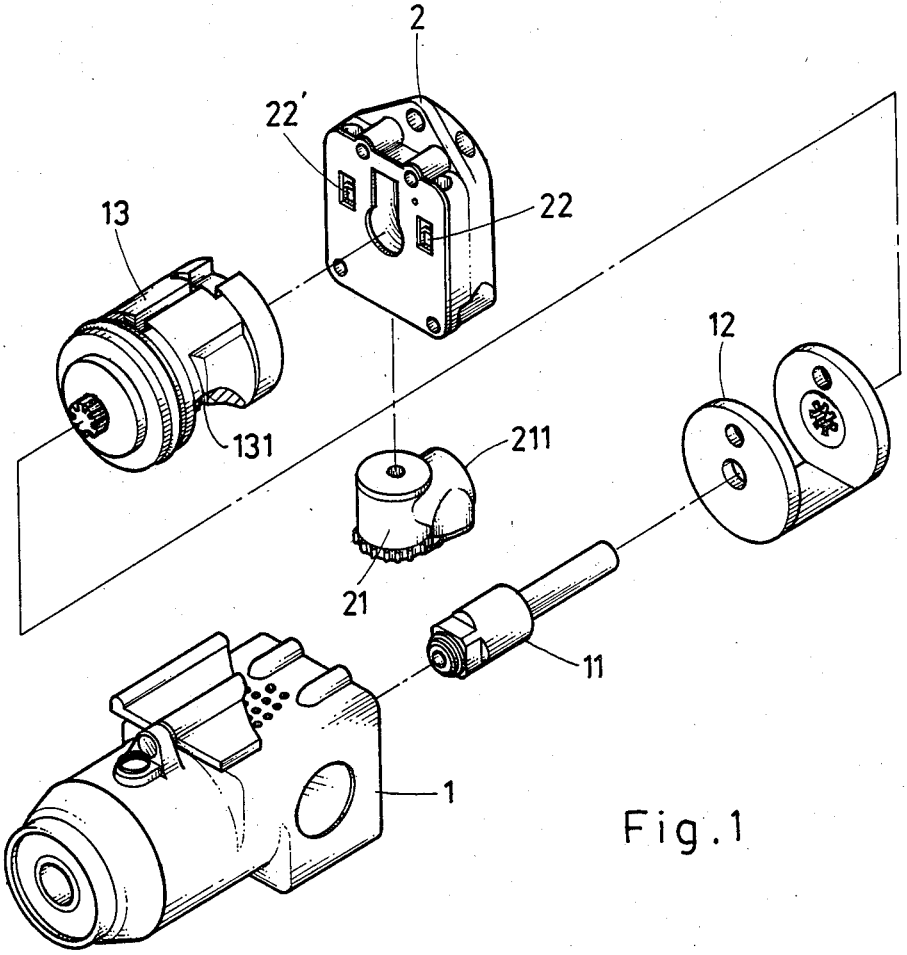
FIG. 1 is an exploded view of the inner parts of a pneumatic tool driver in accordance with the present invention.

In FIG. 1, the part of a pneumatic tool shown mainly comprises a body (1), within which there are some internal parts. These internal parts are a rotor (11), a rotor seat (12), and a motor (13), which are enclosed in the body (1) by a back cover (2).

A compressed air inlet (21) is incorporated in the bottom of the back cover (2). The compressed air inlet (21) has an inlet port (211) for entry of compressed air through the back cover (2). The front end of the back cover (2) is connected to the motor (13). The motor 13 has its rear end connected to the compressed air ports (22) and (22') at the front end of the back cover (2) so that the motor (13) can generate power to rotate the rotor (11) in the rotor seat (12) in order to drive a tool connected to the front end of the rotor (11).

Figure 2:
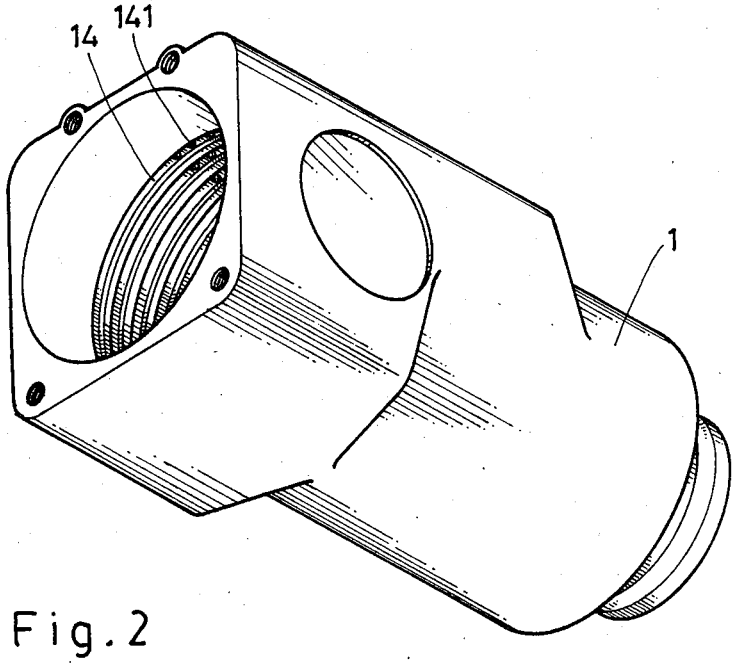
FIG. 2 is a perspective view of a noise suppressor according to the present invention.

After entry into the motor (13) for generation of power, the compressed air is discharged from a compressed air discharge port (131) at the lower side of the motor (13). Since the motor (13) is built into the body (1), the compressed air from the discharge port (131) is led to the inner wall of the body (1). With reference to FIG. 2, there are a plurality of annular or spiral suppression groove (14) on the inner wall of the body (1) and a plurality of air holes (141) at the bottom of the suppression grooves (14) on a lateral wall on the body (1) for discharging the compressed air from the motor (13).

The compressed air discharged from the motor (13) via the discharge port (131) into the body is then suppressed by the suppression grooves (14) at the inner wall of the body. Disturbance to the compressed air flow and collision with the suppression grooves and side wall prolong the time of air discharge and thus, the noise from discharge of compressed air from the pneumatic tool (1) is suppressed.

I claim:

1. A pneumatic tool having suppressed noise characteristics, comprising:

a body defining an inner surface;

a pneumatic motor positioned in said body, said pneumatic motor having an air inlet and an air discharge port adjacent said inner surface;

a plurality of annular or spiral noise suppression grooves defined on said inner surface of said body; and a plurality of air discharge openings defined through said body in said noise suppression grooves;

whereby the flow of air from the air discharge port of the pneumatic motor to said air discharge openings through said body is disturbed by the noise suppression grooves.

* * * * *